United States Patent [19]

Boyd et al.

[11] Patent Number: 4,624,654

[45] Date of Patent: Nov. 25, 1986

[54] METHOD AND APPARATUS FOR MANUFACTURING DRAW TAPE BAGS

[75] Inventors: Dana M. Boyd, Rushville; Franz Bustin, Rochester, both of N.Y.

[73] Assignee: Mobil Oil Corporation, New York, N.Y.

[21] Appl. No.: 652,254

[22] Filed: Sep. 20, 1984

[51] Int. Cl.[4] ..... B31B 1/64

[52] U.S. Cl. ..... 493/194; 493/224; 493/225; 493/232

[58] Field of Search ..... 493/225, 928, 194, 196, 493/199, 213, 231, 239, 243, 232, 461, 255, 440, 447, 456, 248, 246, 357, 362, 369, 381, 195, 197, 202; 112/141, 147, 152, 137, 121.26, 121.27; 226/197

[56] References Cited

U.S. PATENT DOCUMENTS

| | | | |
|---|---|---|---|
| 1,147,876 | 7/1915 | Logsdon | 383/42 |
| 2,656,769 | 10/1953 | Hultkrans | 493/35 |
| 2,777,491 | 1/1957 | Ashton et al. | 493/209 |
| 2,798,523 | 7/1957 | Barrett | 150/11 |
| 2,863,365 | 12/1958 | Piazze | 493/214 |
| 2,883,913 | 4/1959 | Piazze | 493/213 |
| 2,897,729 | 8/1959 | Ashton et al. | 493/225 |
| 2,971,874 | 2/1961 | Canno | 493/197 |
| 3,010,640 | 11/1961 | Kugler | 229/63 |
| 3,013,597 | 12/1961 | Moran | 150/11 |
| 3,029,853 | 4/1962 | Piazze | 150/11 |
| 3,058,402 | 10/1962 | Kugler | 493/196 |
| 3,099,237 | 7/1963 | Currin et al. | 112/252 |
| 3,166,457 | 1/1965 | Nichols | 156/269 |
| 3,166,966 | 1/1965 | Ruschmann | 83/355 |
| 3,196,757 | 7/1965 | Samways | 493/225 |
| 3,285,309 | 11/1966 | Northcott | 150/11 |
| 3,361,041 | 1/1968 | Grob | 493/221 |
| 3,406,610 | 10/1968 | Golden | 493/196 |
| 3,414,032 | 12/1968 | Jortikka | 150/1.7 |
| 3,454,447 | 7/1969 | Corbett et al. | 156/351 |
| 3,460,441 | 8/1969 | Davis, Jr. | 493/194 |
| 3,460,741 | 8/1969 | Kugler | 229/56 |
| 3,470,795 | 10/1969 | Davis, Jr. | 493/190 |
| 3,505,776 | 4/1970 | Cloud | 53/51 |
| 3,506,048 | 4/1970 | Jortikka | 150/1.7 |
| 3,512,456 | 5/1970 | Meyer | 493/928 |
| 3,527,633 | 9/1970 | Bertoglio | 156/353 |
| 3,543,999 | 12/1970 | Kugler | 229/56 |
| 3,547,341 | 12/1970 | Kirkpatrick | 229/63 |
| 3,552,639 | 1/1971 | Meyer | 229/63 |
| 3,568,576 | 3/1971 | Lehmacher et al. | 493/194 |
| 3,596,824 | 8/1971 | Lehmacher et al. | 229/54 |
| 3,653,583 | 4/1972 | Meyer | 229/54 |
| 3,656,415 | 4/1972 | Hook, Jr. | 493/196 |
| 3,687,357 | 8/1972 | Hansen | 229/63 |
| 3,720,141 | 3/1973 | Stock | 493/194 |
| 3,721,383 | 3/1973 | Dufes et al. | 229/63 |
| 3,738,567 | 6/1973 | Ruda | 229/62 |
| 3,738,568 | 6/1973 | Ruda | 229/62 |
| 3,743,567 | 7/1973 | Abler | 156/553 |
| 3,752,388 | 8/1973 | Lynch | 229/54 |
| 3,772,968 | 11/1973 | Ruda | 493/225 |
| 3,774,837 | 11/1973 | Franson | 229/54 |
| 3,803,990 | 4/1974 | Pedersen | 493/224 |
| 3,859,895 | 1/1975 | White | 493/225 |
| 3,889,871 | 6/1975 | White | 229/65 |
| 3,908,522 | 9/1975 | Bender | 493/194 |
| 3,954,049 | 5/1976 | Brieske | 493/188 |
| 3,994,209 | 11/1976 | Jacob | 493/28 |
| 4,055,109 | 10/1977 | Kan | 493/196 |
| 4,138,932 | 2/1979 | Mowli | 493/195 |
| 4,174,597 | 11/1979 | Mowli | 53/410 |
| 4,471,641 | 9/1984 | Mitchell | 83/405 |

*Primary Examiner*—Lowell A. Larson
*Assistant Examiner*—Robert Showalter
*Attorney, Agent, or Firm*—Alexander J. McKillop; Michael G. Gilman; Charles J. Speciale

[57] ABSTRACT

A method of forming plastic film bag bodies with draw strips comprises the steps of providing a continuous length of plastic film once folded to provide superposed panels and two free longitudinal edges opposite a fold edge, folding the two longitudinal free edges inwardly between the adjoining panels to provide a pair of longitudinal inwardly turned hems of double thickness, inserting a continuous material draw strip into each hem, joining together longitudinally the double layer thicknesses of each hem to form a channel along a longitudinal edge of each panel containing one of the continuous strips and transversely severing the material and strips at regular intervals to separate individual bag body lengths from the continuous web of material. Holes are punched along the folded hems of the bag before the draw tapes are inserted so as to allow access to the inserted tapes in the manufactured bag.

13 Claims, 9 Drawing Figures

METHOD AND APPARATUS FOR MANUFACTURING DRAW TAPE BAGS

FIELD OF THE INVENTION

This invention relates to the manufacture of bags and, in particular, to the manufacture of draw tape bags from thermoplastic films.

BACKGROUND OF THE INVENTION

Draw tape bags have been known for several years and are described in various references such as, for example, U.S. Pat. Nos. 2,798,523 and 3,029,853. Bags of this type are formed by two pliable plastic sheets joined to one another on three sides and open at a fourth. A tubular hem is provided at the open edge of each sheet and contains a pliable thermoplastic strip. One or more holes in the hem expose the strip or strips, allowing it or them to be pulled through the opening and used as a handle while simultaneously closing the open mouth of the bag.

One conventionally employed method of forming such bags is described in U.S. Pat. No. 3,772,968 to Ruda. There, separate draw tape strips are positioned near either longitudinal side edge of a single, flat sheet of thermoplastic film. The extreme edges of the material are then turned over the strips forming hems. The sheet is medianly folded to bring the hems together in an adjoining relationship. The continuous length of folded film is thereafter transversely heat sealed and severed to form individual bags. One distinct disadvantage of this method of manufacturing and the apparatus employed to practice it is that a relatively large workspace must be provided in order to work with the unfolded sheet of material.

Another method employed for forming string-tied bags is described in U.S. Pat. No. 3,512,456 to Meyer. According to the Meyer patent, a draw string bag is provided by positioning draw strings on the exterior surfaces of a medianly folded length of thermoplastic film near the two longitudinal "free" edges and outwardly folding the free edges over the string to form hems. While this method allows the use of a length of medianly folded thermoplastic film and reduces floor space requirements, it results in a bag having an unsightly exposed hem.

OBJECTS OF THE INVENTION

It is one object of the invention to provide a method of forming draw tape bags which operates on an initially once folded sheet of bag stock material, so as to reduce the floor space which must be allocated for the making of such bags.

It is yet another object to provide a novel method of forming draw tape bags with internal hems.

SUMMARY OF THE INVENTION

The invention is a novel method and apparatus for forming draw type bags. According to the invention, bag bodies are formed by providing a length of pliable bag material such as thermoplastic film, longitudinally folded so as to have a longitudinal fold edge and two adjoining material layers, each with a longitudinal layer edge opposite the longitudinal fold edge. The longitudinal layer edges are folded inwardly between the adjoining layers to provide a pair of longitudinal hems opposite the longitudinal folded edge of the material, each hem formed a double layer thickness of material. Continuous draw tape strips are thereafter inserted into each hem and the double layer thickness of plastic longitudinally joined together to form a channel containing one of the continuous strips. The continuous length of hemmed, longitudinally sealed and folded plastic film and plastic tapes are thereafter transversely severed to provide individual bag body lengths. The final bag is formed by sealing the transverse edges of the bag bodies. In the exemplary embodiment, sealing and severing are performed simultaneously but sequential sealing and severing steps can be employed with proper equipment.

According to yet another important aspect of the invention, the material is continuously advanced through the folding and inserting steps.

Yet another important aspect of the invention is that holes are provided in each hem between the folding and inserting steps so as to expose the subsequently inserted strip. In the described embodiment, the holes are cut at regular intervals along each hem as the material is continuously advanced between the folding and inserting steps. In particular, holes are punched simultaneously in the longitudinal fold edges of the hems as the material is continuously advanced.

Another important aspect of the invention is an improvement apparatus for forming bags which includes a hemmer and tape inserter positioned between a feed roll of longitudinally folded pliable bag body material or other material, feeding device and a pair of pinch rollers, or other device for advancing the material away from the roll. The hemmer folds the two free longitudinal edges of the material, inwardly between the two layers to form two inward folded hems opposite the original longitudinal folds. A draw tape inserter inserts continuous lengths of tape material into each of the hems formed by the hemmer.

A reciprocating punch is positioned between the hemmer and the inserter for forming a hole in each hem to expose the subsequently inserted strip.

BRIEF DESCRIPTION OF THE DRAWINGS

The invention will be better understood through the subsequent details description and by references to the accompanying figures, in which.

DETAILED DESCRIPTION OF THE INVENTION

The invention includes a method and apparatus for carrying out the method of forming bags inwardly hemmed at their mouths and containing in the hem a strip of material for use as a draw closure, for reinforcement of the mouth or for other purposes.

Figure 1:
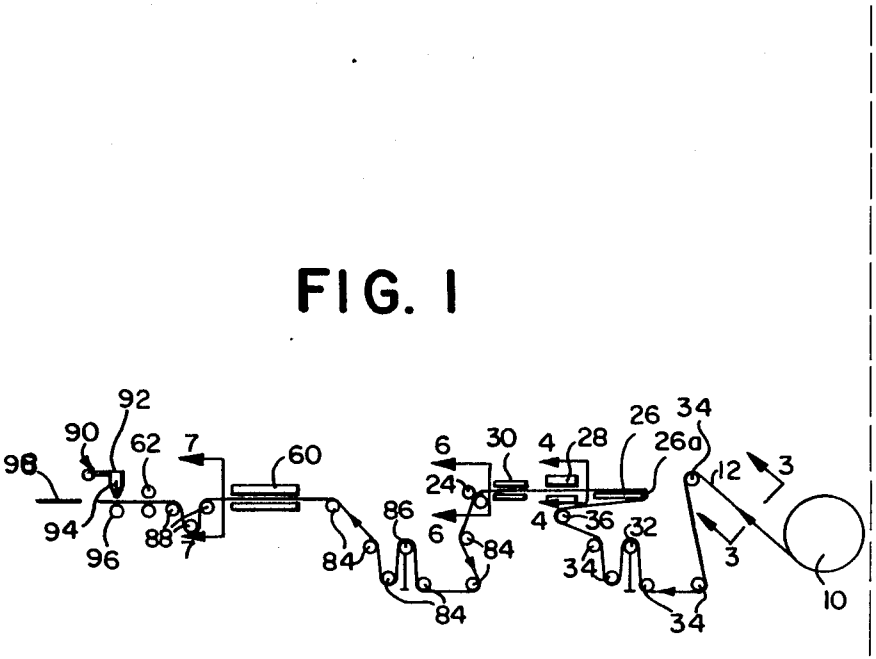
FIG. 1 depicts diagrammatically an exemplary apparatus for carrying out the method of the invention.
Figure 3:
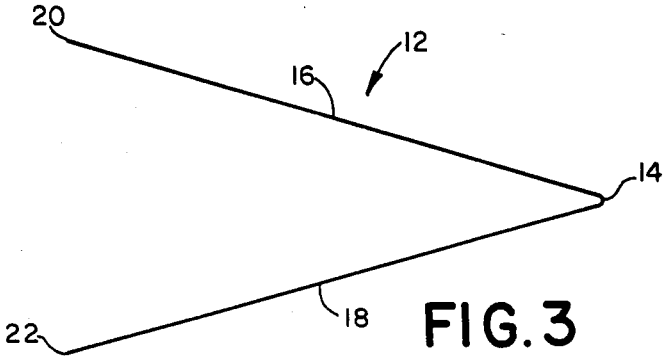
FIG. 3 is a diagrammatic transverse sectional view along the line 3—3 in FIG. 1 depicting the longitudinally folded continuous length of bag material being fed into the apparatus.

An exemplary embodiment of the invention is depicted diagrammatically in FIG. 1 and is used for the manufacture of draw tape thermoplastic bags according to the invention. It is envisioned that the method and apparatus can also be used to form bags of other suitably pliable materials, such as fabric, and bags which require and inwardly hemmed double thickness of the material at the bag mouth and a strip of closure, reinforcement or laminating pliable material such as plastic, glass reinforced or other foldable tapes, string, cloth or other sufficiently pliable material in one or both hems.

The apparatus of FIG. 1 includes a roll 10 feeding a continuous length of folded thermoplastic film 12 depicted further in FIGS. 3–7. The film 12 is folded along a longitudinal line, in this particular example a median longitudinal line, and has a longitudinal fold edge 14, two adjoining material layers 16 and 18, and two free longitudinal layer edges 20 and 22 opposite the longitudinal fold edge 14. The material is drawn from the roll 10 by means of pinch rollers 24 through a hemmer 26, punch 28 and tape inserter 30. The pinch rollers 24 advance the continuous length of film 12 at a constant rate. Roller 32 is adapted for movement in the vertical plane to provide, in a convention and well known fashion, a constant tensioning on the length of material 12 as it enters the hemmer 26. The roller 32 rises to take up slack when the roller 10 is feeding material 12 at a rate faster than it is being advanced by the pinch rollers 24 and falls to provide additional material when the converse is true. The roller 32 may also be connected in conventional and well known ways with a drive motor motion, brake or oombination motor/brake apparatus associated with the roll 10 in order to control the rotation rate of the roll and keep its feed rate closely adjusted to the rate of advancement of the pinch rollers 24. Fixed rollers 34 direct the film towards and away from the movable roller 32.

Figure 4:
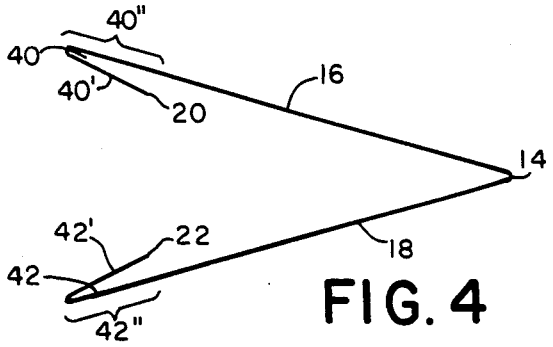
FIG. 4 is a diagrammatic transverse sectional view along the lines 4—4 of FIG. 1 depicting the length of bag material in the form it exits the hemmer apparatus.

The hemmer 26 inwardly folds the two free longitudinal edges 20 and 22 inwardly between the adjoining layers 16 and 18 towards the center of the longitudinal edge fold 14 in the manner depicted in FIG. 4. An apparatus for simultaneously inwardly hemming the two free longitudinal edges is depicted and described in detail in a related co-pending application Ser. No. 652,255, filed Sept. 20, 1984, and entitled Method and Apparatus for Forming Hems in Superposed Pliable Panels, incorporated herein in its entirety by reference. The continuous length of material 12 leaving the hemmer apparatus 28 has been provided with two longitudinally extending hems 40 and 42, each formed by double layer thicknesses of the thermoplastic film at the new longitudinal edges 20′ and 22′ opposite the original folded edge 14. Each hem 40 and 42 is formed by folded longitudinal portions 40′ and 42′, respectively, adjoining the free edges 20 and 22, respectively, of the material and the adjoining portions 40″ and 42″, respectively of the remainder of the layers 16 and 18.

Figure 5:
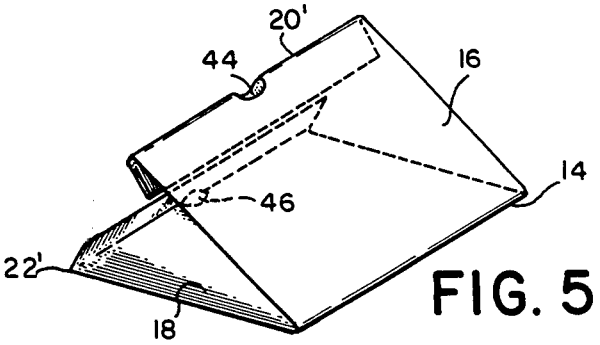
FIG. 5 is a perspective diagrammatic view of a portion of the length of bag material exiting the hole punch.

The punch 28 forms a hole in the longitudinal edge of each hem. These holes are depicted in FIG. 5, the holes 44 and 46 being formed in the longitudinal edges 20′ and 22′ of the hems 40 and 42 respectively. Because the holes 44 and 46 are formed by removing a portion of the edge of each hem, a conventional reciprocating punch 28 can be used to cut holes 44 and 46 simultaneously through the two hems in a single descending motion. Because it is pliable, the advancing material simply bends or deflects around the descended punch until the punch withdraws. The rate of the punch 28 is coordinated with the film advance rate of the pinch rollers 24 to form holes 44 and 46 at regular, one bag pitch intervals along the length of the advancing film 12.

Figure 6:
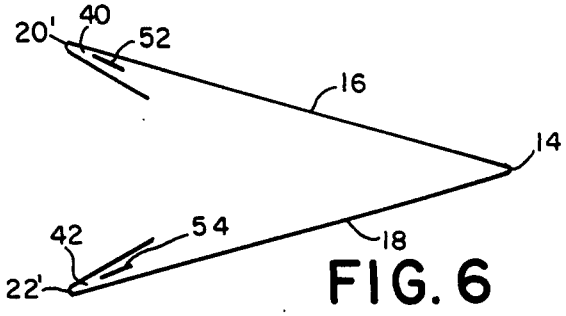
FIG. 6 is a diagrammatic transverse sectional view along the lines 6—6 of FIG. 1 depicting the hemmed length of bag material exiting the tape strip inserter.

After hole forming, the film is passed through a tape inserting apparatus 30 which positions a continuous length of thermoplastic tape strips 52 and 54 in each hem 40 and 42, respectively. The tapes 52 and 54 form the handles and draw closures of the bag. The condition of the material 12 after leaving the tape inserter 30 is depicted in FIG. 6. An apparatus for continuously and simultaneously inserting pliable continuous tape strips into inward opening hems 42 and 44 is described and depicted in a separate related patent application Ser. No. 652,252, filed Sept. 20, 1984 entitled Insertion of Draw Tape Strips in Draw Tape Bag Manufacture and is incorporated herein in its entirety by reference.

Figure 7:
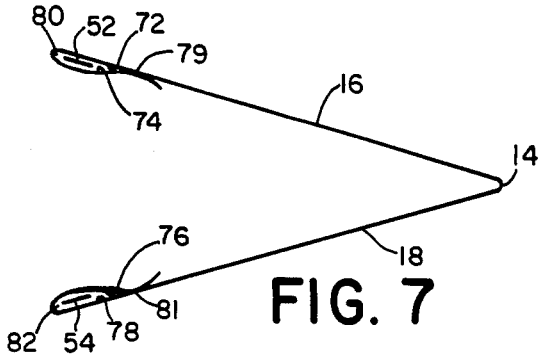
FIG. 7 is a diagrammatic transverse sectional view along the lines 7—7 of FIG. 1 depicting the continuous length of bag material and continuous hem strips following heat sealing of each hem to form a pair of hem channels each containing one continuous strip.

Referring to FIG. 1 again, the continuous length of film 12 with continuous strips 52 and 54 is advanced from the pinch rollers 24 through rollers 84 and 86 and a hem sealer 60 by means of a second pair of pinch rollers 62. The hem sealer 60 is a conventional piece of thermoplastic bag forming equipment provided by any of a number of commercial suppliers such as, for example, Park Air of Brockton, Massachusetts, or AMI Corporation (formerly Atlanta-Mesco) of Atlanta, Ga. A Park Air model HS-1400 intermittent thermal sealer may be used as the hem sealer 60. The Park Air apparatus (not depicted) separates the juxtaposed hems 42 and 44 from one another by means of a platen inserted between the superposed hems 40 and 42 and layers 16 and 18. Reciprocating heater bars on either side of the platen heat seal the facing surfaces 72–74 of panel 16 and lip 40′, respectively, and the facing surfaces 76–78 of panel 18 and lip 42′, respectively, (see FIG. 6) to one another, to form channels 80 and 82, as are depicted in FIG. 7. Each channel 80 and 82 contains one of the continuous strips 52 and 54, respectively. The longitudinal heat seals 79 and 81 are also shown in FIG. 7.

Referring again to FIG. 1, stationary rollers 84 direct the material 12 from the first set of pinch rollers 24 to the hem sealer 60 over a second vertically moving roller 86. The roller 86 takes up the slack in the film 12 when the pinch rollers 62 are intermittently stopped to allow the hem sealer 60 to operate. As the length of continuous hem sealed film 12 exits the hemmer 60, it is passed through a "U-wrap" set of rolls 88*a*–88*c* and through the second pinch rollers 62 to a seal/cutter assembly 90. The rolls 88*a* and 88*c* stretch (i.e. apply tension to) the upper panel of the web while roll 88*b* stretches the lower panel of the web to smooth out any wrinkles which may have developed in the panels earlier in the process before the web passes through rolls 62. Wrinkles sometime develop in the panels because of uneven stretching of the film in the extrusion process. The assembly 90 is also a conventional piece of thermoplastic bag forming equipment provided by any of several suppliers. At least one FMC Corporation machine can be used in the manner described. The assembly includes a reciprocating heat seal bar 92 carrying a knife edge 94. A roller 96 provides an opposing surface supporting the web 12. In an intermittent action timed to coincide with the operation of the hem sealer 60, transversely heat seals facing portions of the plastic layers 16 and 18 to one another and the inner facing surfaces 72–74 and 76–78 of each hem 52 and 54 to the contained strip 52 and 54, respectively, to form a heat bonded, laminate seal region through and across the strip 12 at regular intervals along its length. After bonding, the seal bar 90 also transversely severs the continuous length of material 12 through the center of the heat seal, thereby separating an individual bag body length 96 from the continuous length 12. If desired, the transverse sealing and cutting operations can be performed separately with different equipment.

Figure 8:
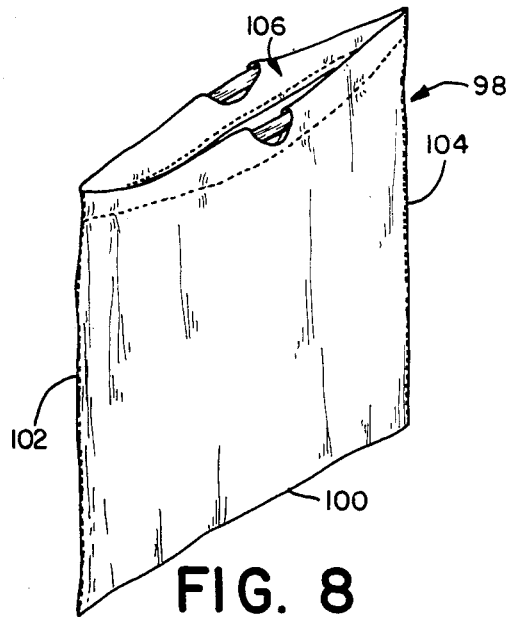
FIG. 8 is a diagrammatic perspective view of an individual bag body formed by transversely severing a portion of the continuous length of material exiting the hem sealer and closing the severed edges.
Figure 9:
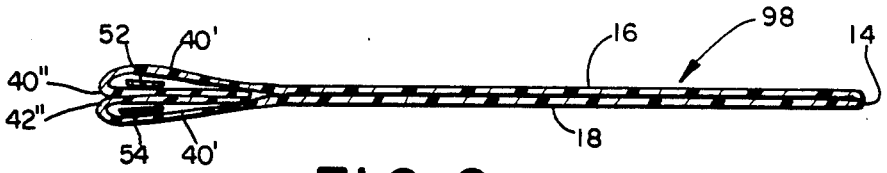
FIG. 9 is a diagrammatic side view of the bag of FIG. 8 depicting the transverse edge heat seal bond, the hem region laminates being separated from one another in the depiction for clarify.

A finished bag body is depicted in FIG. 8 and includes a base edge 100 formed by the fold 14 in the continuous fold of material, two opposing transverse heat sealed edges 102 and 104, and an open mouth 106 for access to the interior of the bag. The laminate layers of the edge 102 of the bag 98 are depicted in FIG. 9.

Figure 2:
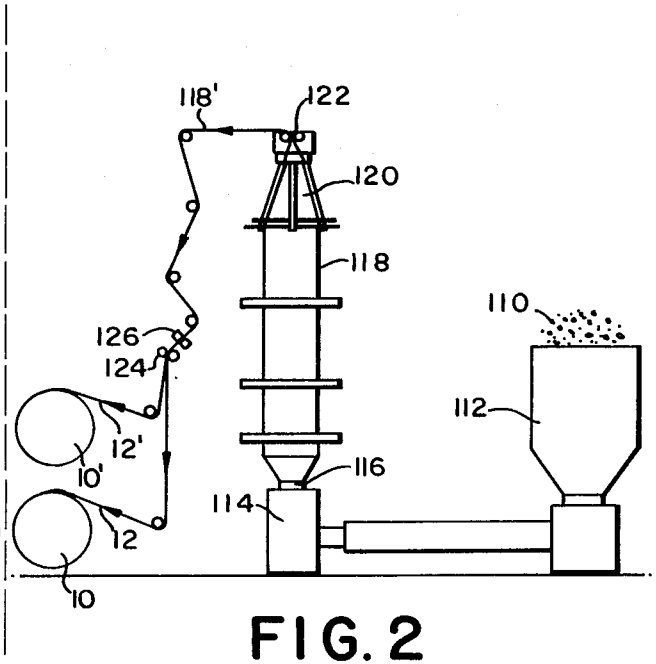
FIG. 2 depicts diagrammatically an exemplary apparatus for providing a folded sheet of pliable bag material to be operated upon by the apparatus of FIG. 1.

FIG. 2 depicts one method of providing the roll 10 of once folded thermoplastic film 12. Raw plastic stock 110 is fed into a hopper 112, is heated and forced by an extruder assembly 114 through a circular die ring 116 to form a continuous tubular column 118 of extruded thermoplastic film. The film is collapsed by a collapsing tower structure 120 and pair of pinch rollers 122 at the top of the column and drawn off by the pinch rollers 122. A second pair of pinch rollers 124 draws the collapsed tube of plastic film 118 past a knife 126 which longitudinally severs the flattened tube of film 118 at its center to provide two rolls 10 and 10' of double thickness film 12 and 12', each having one folded longitudinal edge, two adjoining film layers and two free longitudinal edges opposite the longitudinal folded edge. Alternatively, other conventional means can be used to provide the longitudinally folded length of thermoplastic material 12. For example, the collapsed tube 118 may be slit along one side edge to provide a single length of the film 12. Alternatively, a flat single layer of the film may be longitudinally folded by conventional means and wrapped upon a roll 10 or feed directly into the rollers 34 of FIG. 1.

While one embodiment of the invention has been described, it is envisioned that variations and improvements will be apparent to one skilled in the art. Therefore, the invention is not limited to the disclosed embodiment but is set forth in the accompanying claims.

We claim:

1. A method of forming bag bodies comprising the steps of:

providing a continuous length of pliable bag material folded once longitudinally and having a longitudinal fold edge, and two adjoining material layers each with longitudinal free edge opposite the longitudinal fold edge;

folding the two longitudinal free edges inwardly between said adjoining layers to provide a pair of longitudinal hems of double layer thickness opposite said longitudinal fold edge;

inserting a separate, continuous material strip into each hem, said pliable bag material being continuously and uninterruptedly advanced through said folding and inserting steps;

longitudinally joining together the double layer thicknesses of each hem to form a channel along the longitudinal edge of each layer opposite the longitudinal fold containing one of the continuous strips; and transversely severing the pliable bag material and strips at regular intervals along the length of the pliable bag material to separate individual bag body lengths from the continuous length of pliable bag material.

2. The method of claim 1 further comprising between said folding and inserting steps the step of:

providing a hole in each hem to expose the subsequently inserted strip.

3. The method of claim 2 further comprising the step of continuously advancing the material through the folding, hole providing and inserting steps.

4. A method of claim 3 wherein said hole forming step comprises punching holes at regular intervals along each hem as the material advances between the folding and inserting steps.

5. The method of claim 4 wherein said step of punching holes comprising the step of:

penetrating the advancing material with a hole punching member moving only normally to said advancing material.

6. The method of claim 5 wherein said hole punching step further comprises the step of:

advancing unpunched material across the hole punching member until the member is withdrawn from contact with the material.

7. The method of claim 1 wherein the material is thermoplastic and said longitudinally joining step comprises:

heat sealing together the double layers of the material of each of the two hems to form said channels.

8. The method of claim 7 further comprising before said severing step the step of:

heat sealing the two adjoining material layers at regular intervals across the length of the material to form regularly spaced, transverse seal joints; and said step of severing comprises severing through the heat seal joints formed by said heat sealing step.

9. The method of claim 8, wherein said strips are thermally bondable to said thermoplastic material and said step of heat sealing the adjoining material layers further comprises heat bonding said strips at said regular intervals to interior surfaces of the hems adjoining the strips.

10. In an apparatus for forming bag bodies comprising feed means for feeding a continuous length of longitudinally foled material having a longitudinal fold edge connecting two adjoining material layers, each with a longitudinal free edge opposite the longitudinal fold edge, advancing means spaced from the feed means for advancing the length of folded material away from the feed means, and severing means for severing the advancing length of material transversely at regular intervals to provide individual bag body lengths the improvement comprising:

hemming means between the feed means and advancing means for folding the longitudinal layer free edges inwardly between said adjoining layers to provide a pair of longitudinal hems of double layer thickness opposite said longitudinal foled edge;

insertion means between the hemming means and advancing means for inserting a separate, continuous material strip into each hem;

hem sealing means between said advancing means and said severing means for longitudinally joining together the double layer thickness of each hem to form a channel; and wherein said means for advancing advances said length of material continuously and uninterruptedly away from said feed means and through said hemming means and said insertion means.

11. The improvement of claim 10 further comprising:

hole forming means between said hemming means and said insertion means for forming a hole in each hem to expose the subsequently inserted strip.

12. The improvement of claim 11 wherein said hole forming means comprises:

a punch reciprocating transversely to said adjoining layers.

13. The method of claim 12 wherein said punch is fixedly mounted between said hemming means and said insertion means preventing movement of the punch parallel with the advancing web.

* * * * *